US008368730B2

(12) United States Patent
Fox et al.

(10) Patent No.: US 8,368,730 B2
(45) Date of Patent: Feb. 5, 2013

(54) APPARATUS AND METHOD FOR MARKING DIFFERENT SURFACE PARTS OF AN OBJECT MOVING ALONG A LINE

(75) Inventors: Andrew Fox, North Arlington, NJ (US); Andrew John James, Peterborough (GB)

(73) Assignee: Domino Printing Sciences PLC (GB)

( * ) Notice: Subject to any disclaimer, the term of this patent is extended or adjusted under 35 U.S.C. 154(b) by 212 days.

(21) Appl. No.: 12/529,481

(22) PCT Filed: Feb. 29, 2008

(86) PCT No.: PCT/GB2008/000717

§ 371 (c)(1), (2), (4) Date: May 14, 2010

(87) PCT Pub. No.: WO2008/107659

PCT Pub. Date: Sep. 12, 2008

(65) Prior Publication Data

US 2010/0214387 A1 Aug. 26, 2010

(30) Foreign Application Priority Data

Mar. 2, 2007 (GB) ..... 0704078.5

(51) Int. Cl.
*B41J 2/00* (2006.01)

(52) U.S. Cl. ..... 347/110

(58) Field of Classification Search ..... 347/110, 347/20; 101/35, 37, 329; 399/2
See application file for complete search history.

(56) References Cited

U.S. PATENT DOCUMENTS

| | | | | | |
|---|---|---|---|---|---|
| 2,909,991 | A * | 10/1959 | Farkas | 101/35 |
| 2,927,525 | A * | 3/1960 | Baumgartner | 101/35 |
| 2,927,526 | A * | 3/1960 | Parham | 101/37 |
| 3,745,920 | A * | 7/1973 | McKay | 101/329 |
| 3,960,072 | A * | 6/1976 | Ahlgren et al. | 101/35 |
| 4,745,857 | A | 5/1988 | Putnam et al. | |
| 4,901,095 | A * | 2/1990 | Perra et al. | 347/20 |
| 5,101,224 | A | 3/1992 | Freed, Jr. | |
| 6,618,563 | B2 * | 9/2003 | Oakeson et al. | 399/2 |
| 2003/0041973 | A1 | 3/2003 | Soto et al. | |
| 2004/0011227 | A1 * | 1/2004 | Shadrach, III | 101/35 |

FOREIGN PATENT DOCUMENTS

| | | |
|---|---|---|
| EP | 1537917 | 6/2005 |
| WO | 03102755 | 12/2003 |

* cited by examiner

*Primary Examiner* — Stephen Meier
*Assistant Examiner* — Carlos A Martinez
(74) *Attorney, Agent, or Firm* — Price Heneveld LLP

(57) ABSTRACT

The invention describes an apparatus (10) for applying marking to perpendicular surfaces (15, 17) of an object (16) being conveyed along a line (11). A single marking head (12) is mounted on a positioning arm (14) which directs the marking head across the direction of the conveyor while applying marking to a first surface (15) of the object. The marking head is then rotated through 90° and held at one side of the conveyor so that a second, perpendicular, surface (17) of the object can be marked as the object is conveyed past the marking head. The invention uses the kinetic energy of the moving object to effect movement of the marking head.

9 Claims, 3 Drawing Sheets

APPARATUS AND METHOD FOR MARKING DIFFERENT SURFACE PARTS OF AN OBJECT MOVING ALONG A LINE

FIELD OF THE INVENTION

This invention relates to marking and/or coding and has been developed, in particular, for application to industrial and/or commercial marking and coding equipment.

BACKGROUND TO THE INVENTION

It is known in marking and coding art to apply a code to an outer case or carton as it moves down a delivery conveyor. An example of this is the application of a barcode to the surface of the case, the barcode being applied by a non-contact print-head mounted in a fixed position on one side of the delivery conveyor. As the case is carried past the print-head by the conveyor, marking is emitted from the print-head to impinge on the surface of the case.

In many instances, the appropriate code must be applied to at least two perpendicular surfaces of the case. For example, the code must be applied to the front and a side of the case. Conventionally, this has necessitated the use of two print-heads arranged on sections of the conveyor that are at right angles, and has also meant that the direction of travel of the conveyor must be turned through 90°.

The provision of two print-heads is expensive as is the need to provide additional conveyor sections. The further conveyor sections also occupy additional factory space and the need to displace the delivery line through 90° also limits the delivery speed.

Attempts have been made to effect coding on perpendicular surfaces using a single print-head. Published International (PCT) Patent Application No. WO 03/102755 describes a system for applying printed information to different surfaces of a package. The system includes a printing applicator which moves relative to the package, the applicator being combined with actuation and feedback means to ensure proper positioning of the printing applicator relative to the package. U.S. Pat. No. 4,745,857 and European Patent No. 1 537 917 describe alternative forms of an apparatus for marking different surfaces of objects such as packages or component parts, using a single print-head. However, in both cases, the print-head is positioned by a robotic arm under computer control.

It will be appreciated that the positioning mechanisms described in the patent references discussed above are expensive and the costs thereof are likely to exceed the cost of providing the conventional two print-head system also described above. Further, each particular application involves programming the positioning mechanisms to operate in the required manner.

It is an object of this invention to provide an apparatus and/or a method which will go at least some way in addressing the aforementioned drawbacks, or which will at least offer a novel and useful alternative.

SUMMARY OF THE INVENTION

Accordingly, in a first aspect, the invention comprises a marking apparatus operable to mark different surface parts of an object moving along a line in a line direction, said apparatus including a marking head having a marking direction; and positioning means displaceable and operable to position said marking head so that said marking direction may be aligned substantially with, and substantially perpendicular to, said line direction, said positioning means being further operable to allow translation of said marking head while said marking direction is aligned substantially perpendicular to said line direction, said apparatus being characterized in that said positioning means is, in use, contacted by said object and is displaced by movement of said object as said object moves along said line.

Preferably said positioning means is configured such that displacement of said marking head in said line direction effects translation of said marking head substantially perpendicular to said line direction.

Preferably said translation has a start point and an end point, said positioning means being configured to allow rotation of said marking head into a substantially perpendicular alignment substantially at or adjacent said end point.

Preferably said positioning means comprises an arm pivotally mountable adjacent said line, said arm having a spaced pivot position for mounting of said marking head.

Preferably said apparatus further includes an encoder operable to control the output of said marking head relative to movement of said object.

Preferably said apparatus further includes a return mechanism operable to return said positioning means to a position at which said marking head is substantially at the start point of said translation.

Preferably said return mechanism is configured to apply a two-stage return loading on said positioning means.

Preferably said marking head comprises a drop-on-demand inkjet print-head, a continuous inkjet print-head, a thermal-transfer print-head or a laser print-head.

In a second aspect the invention comprises a method of marking different surface parts of an object moving along a line using a single marking head, said method including emitting marks from said marking head onto a first surface of said object while translating said marking head across said line as said object moves along said line; and rotating the alignment of said marking head substantially through 90° and positioning said marking head adjacent said line;

emitting marks from said marking head onto a second surface part of said object as said object moves past said marking head, said method being characterized in that it employs the movement of said object along said line to effect translation and rotation of said marking head.

Preferably said method further includes controlling the emission of marking from said marking head as a function of movement thereof relative to the first and second surface parts of said object.

Preferably said method involves the operative use of the apparatus set forth above.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

An embodiment of the invention will now be described with reference to the accompanying drawing in which.

DESCRIPTION OF WORKING EMBODIMENT

Referring firstly to FIGS. 1 to 4, the invention provides marking apparatus 10 used to apply marks or codes in an industrial environment. The particular embodiment described herein has been devised and configured to apply markings such as, for example, to objects such as outer cases or cartons passing along a conveyor line 11.

Figure 4:
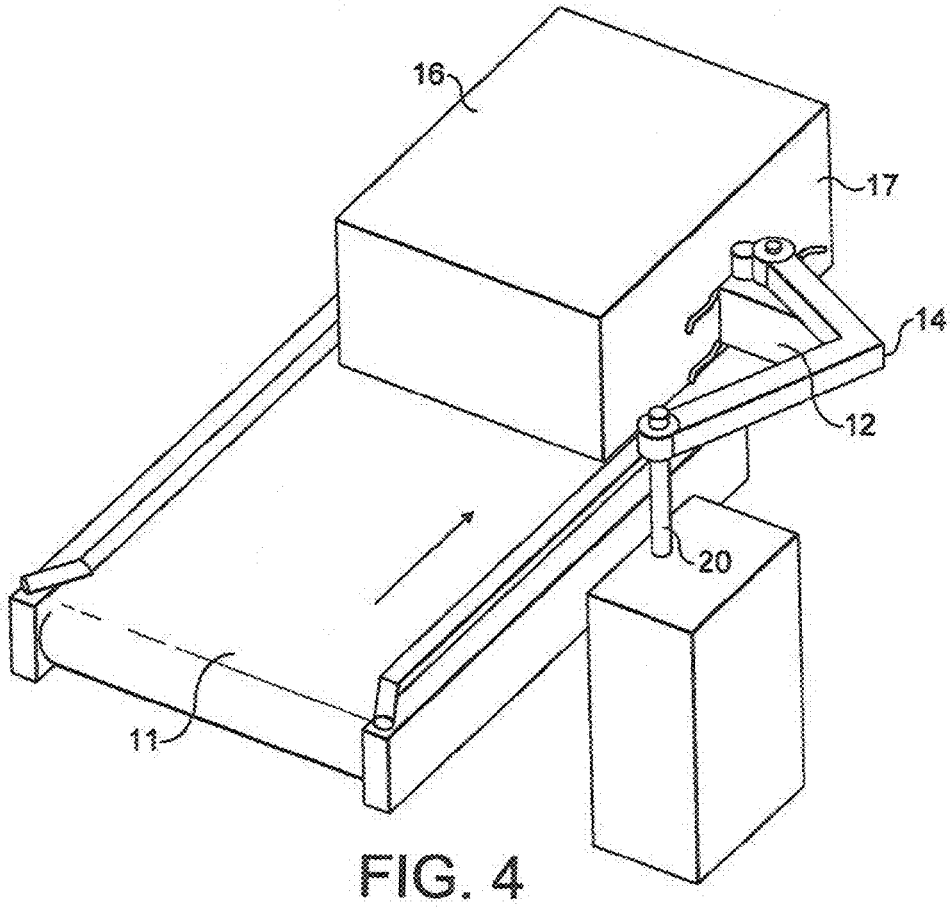
FIG. 4: shows a view similar to those shown in FIGS. 2 and 3 but with the case shown in position and being marked.

In its broadest context, the marking apparatus comprises a marking head 12 and positioning means 14, the positioning means 14 being configured and operable to position the marking head so that it may first apply marking or code to a first surface 15 of a case 16 before being rotated through 90° in which position, as shown in FIG. 4, it may then apply marking or code to a second, perpendicular surface 17 of the case 16. A characteristic feature of the invention is that the marking head is re-positioned using the kinetic energy of the moving case 16.

In the form shown, the positioning means 14 comprises an angled arm. The arm is mounted, at end 18, on a vertical shaft 20, the shaft 20, in turn, being mounted adjacent one side of the conveyor 11. In use the arm rotates about the axis of shaft 20. The marking head 12 is mounted at the other end 19 of the arm and is joined to the arm by a further vertical pivot 21. Thus, the assembly of the marking head and the arm rotates about the axis of the shaft 20 while the marking head also pivots about axis 21.

Figure 1:
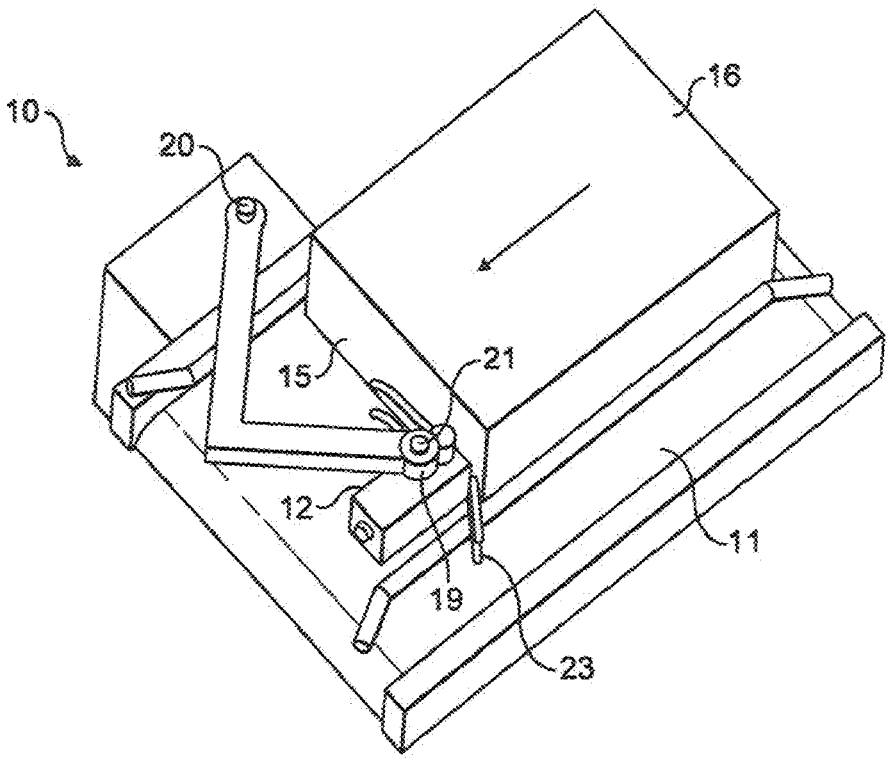
FIG. 1: shows a schematic isometric view of a marking apparatus according to the invention positioned to apply a mark or code to a first surface of a case moving along a conveyor.
Figure 2:
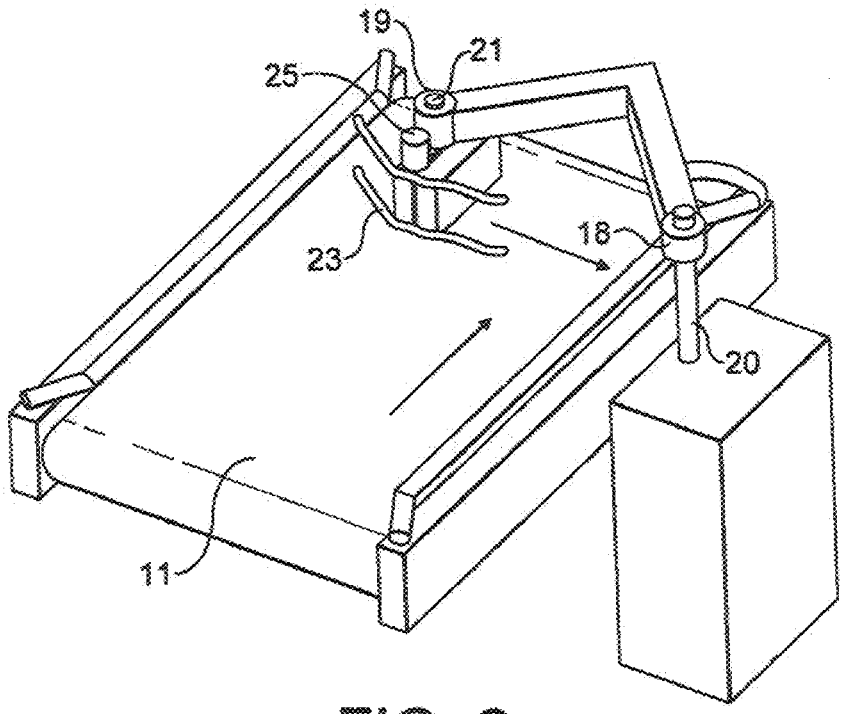
FIG. 2: shows a similar view to FIG. 1, but from the reverse angle, and with the case removed for clarity.
Figure 3:
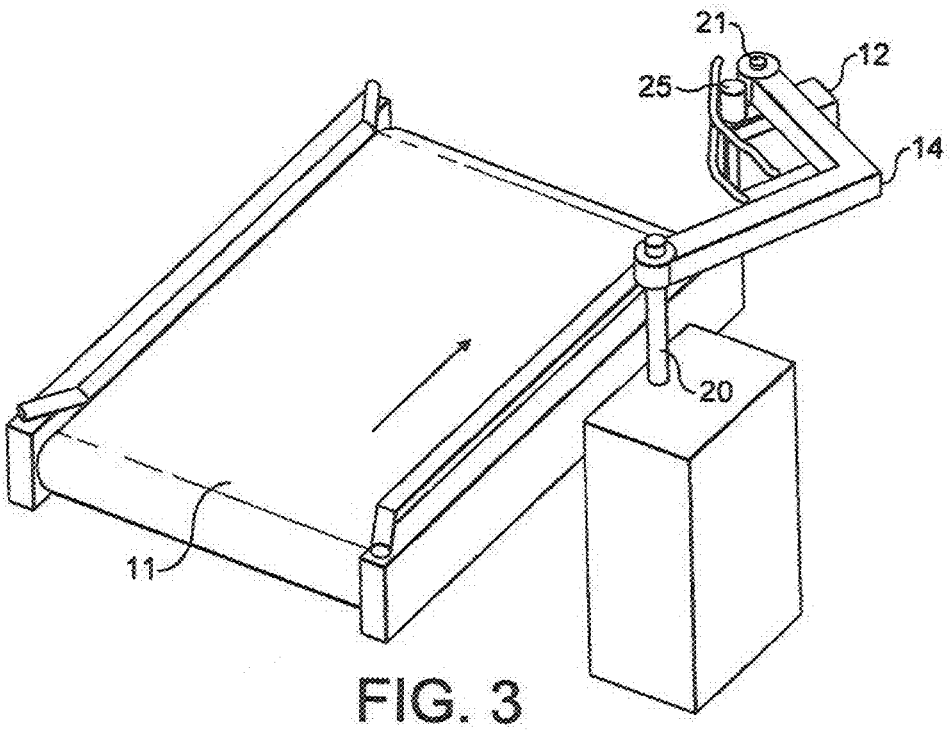
FIG. 3: shows a similar view to FIG. 2 but with the marking apparatus at the end of a translation phase and rotating to commence marking of a second, perpendicular surface of the case.

It will be appreciated that, as the marking head is displaced in the direction of the conveyor 11, or line direction, it is also translated across the conveyor as is apparent from FIGS. 1 to 3. When the marking head 12 reaches the end of the translation phase, adjacent that edge of the conveyor on which the shaft 20 is mounted and as shown in FIG. 3, further displacement of the case 16 causes the marking head to be rotated through 90° and thus be aligned in the correct manner for applying marking on surface 17 of the case. The marking head 12 is then held still in this position as the conveyor displaces the case past the head. As the surface 17 passes the marking head, further marking can be applied thereto.

The positioning means 12 preferably further includes a buffer bracket 23 which overlies the active or ejection surface of the marking head but which is configured so as not to interfere with the passage of the marking medium from the marking head to the surface being marked. The bracket 23 not only keeps the marking head correctly aligned with the surface being marked, but also spaces the marking head the correct distance from the surface being marked to ensure the provision of a good quality print.

The marking head 12 may be of any suitable form known in the art including a multi-nozzle drop-on-demand inkjet print-head, a continuous inkjet print-head, a thermal transfer print-head and/or a laser coding head. To ensure the correct positioning and application of code onto the surfaces 15 and 17, a rotational encoder 25 is provided adjacent the marking head 12. The encoder frictionally engages the surface 15 or 17 of the case 16 and ensures marking is applied as a function of the relative movement between the marking head 12 and the case 16.

Finally, the apparatus 10 includes a return mechanism which is operable to return the marking head 12 to the position shown in FIG. 1, once the case 16 has cleared the marking apparatus from the position shown in FIG. 4. It is important that the resistance applied by the return mechanism to movement of the positioning means 14 be kept to a minimum as excessive resistance may cause the case 16 to slip on the conveyor, and thus interfere with the printing process. With this in mind, the return mechanism is preferably configured to apply a two-stage return loading on the positioning means such that the initial returning force is stronger than that which effects final displacement to the start position.

Figure 5:
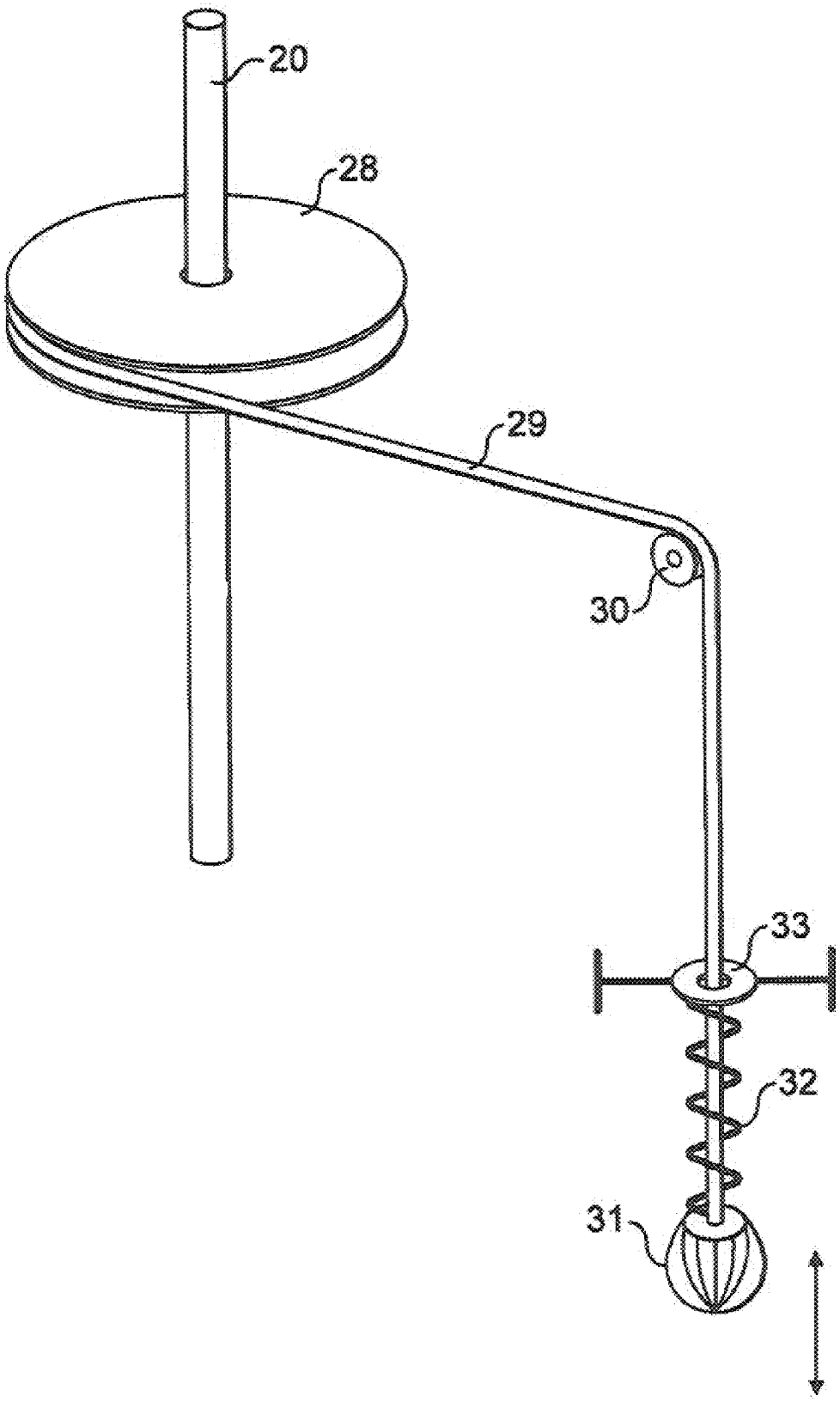
FIG. 5: shows schematically, and not to scale, an isometric view of a return mechanism for incorporation in the apparatus shown in FIGS. 1 to 4.

Turning now to FIG. 5, one form of return mechanism is depicted although it will be appreciated by those skilled in the art that many other arrangements could equally be adopted. In the form shown, a pulley 28 is mounted on shaft 20 for rotation therewith. Fixed to the outer periphery of pulley 28 is a cable 29, the cable 29 being led over a horizontal pulley 30 and having a weight 31 attached to the free end thereof. As the positioning arm 14 is displaced about the axis of shaft 20, by the moving case 16, the cable 29 is wound onto pulley 28 thus raising the weight 31. Once the case 16 has cleared the marking apparatus from the position shown in FIG. 4, the weight 31 causes the pulley 28, and thus the shaft 20, to rotate in a counter-clockwise direction, thus returning the marking head to the start position shown in FIG. 1. The initial boost to the return step, as referred to above, is provided by a compression spring 32, which is located around the cable 29 and is compressed between the weight 31 and a fixed stop 33 as the weight 31 nears an uppermost position. Thus, when the weight is released, its initial movement is supplemented by expansion of the spring 32.

The invention further provides a method of marking substantially perpendicular surfaces of a case 16 moving along a substantially linear conveyor 11 using a single marking head 12. According to the method, marks are emitted from the marking head 12, while in a first alignment, onto a first surface 15 of the case 16 while the marking head is translated across the conveyor path and across the surface 15. At the end of the translation, the marking head 12 is rotated through 90°, held in position adjacent the conveyor path, and operated to emit further marks onto the surface 17 of the case as the case is conveyed past the marking head.

It will be appreciated that the method preferably involves the operative use of the apparatus described in detail above.

It will thus be appreciated that the present invention provides a novel and effective form of apparatus, and a novel and effective method, which allows a single marking head to be used to mark perpendicular faces of a case moving along a conventional single-direction conveyor and using the kinetic energy of the case to effect movement of the marking head. This has considerable benefits in terms of costs and plant space requirements.

The invention claimed is:

1. Marking apparatus operable to mark different surface parts of an object moving along a line in a line direction, said apparatus including a marking head having a marking direction along which marking is, in use, applied to said object; and positioning means displaceable and operable to position said marking head so that said marking direction may be aligned substantially with, and substantially perpendicular to, said line direction, said positioning means being further operable to allow translation of said marking head while said marking direction is aligned substantially perpendicular to said line direction, said apparatus being characterized in that said positioning means is, in use, contacted by said object and is displaced by movement of said object as said object moves along said line and wherein said positioning means is configured such that displacement of said marking head in said line direction effects translation of said marking head in a direction substantially perpendicular to said line direction.

2. Marking apparatus as claimed in claim 1 wherein said translation has a start point and an end point, said positioning means being configured to allow rotation of said marking head through substantially 90° substantially at or adjacent said end point.

3. Marking apparatus as claimed in claim 2 further including a return mechanism operable to return said positioning means to a position at which said marking head is substantially at the start point of said translation.

4. Marking apparatus as claimed in claim 3 wherein said return mechanism is configured to apply a two-stage return loading on said positioning means.

5. Marking apparatus as claimed in claim 1 wherein said positioning means comprises an arm pivotally mountable at a first position adjacent said line, said arm having a pivot position spaced from said first position for mounting of said marking head.

6. Marking apparatus as claimed in claim 1 further including an encoder operable to control the output of said marking head relative to movement of said object.

7. Marking apparatus as claimed in claim 1 wherein said marking head comprises a drop-on-demand inkjet print-head, a continuous inkjet print-head, a thermal transfer print-head or a laser print-head.

8. A method of marking different surface parts of an object moving along a line using a single marking head, said method including emitting marks from said marking head onto a first surface of said object while translating said marking head across said line as said object moves along said line;

rotating the alignment of said marking head substantially through 90° and positioning said marking head adjacent said line; and emitting marks from said marking head onto a second surface of said object as said object moves along said line and past said marking head, said method being characterized in that it employs the movement of said object along said line to effect translation and rotation of said marking head.

9. A method as claimed in claim 8 further including controlling the emission of marking from said marking head as a function of movement thereof relative to the first and second surface parts of said object.

* * * * *